US008418268B2

(12) United States Patent
Waldman et al.

(10) Patent No.: US 8,418,268 B2
(45) Date of Patent: Apr. 16, 2013

(54) GARMENT HAVING SUPPORT

(75) Inventors: Mark Waldman, New Hope, PA (US); Claudia Fua, Lakewood, CA (US)

(73) Assignee: Global Trademarks, LLC, Stockertown, PA (US)

( * ) Notice: Subject to any disclaimer, the term of this patent is extended or adjusted under 35 U.S.C. 154(b) by 103 days.

(21) Appl. No.: 12/631,492

(22) Filed: Dec. 4, 2009

(65) Prior Publication Data

US 2011/0131705 A1 Jun. 9, 2011

(51) Int. Cl.
*A41D 27/20* (2006.01)

(52) U.S. Cl.
USPC ..... 2/248; 2/227; 2/231; 2/275

(58) Field of Classification Search ..... 2/79, 227, 2/228, 235, 234, 247, 248, 236, 237, 220, 2/221, 211, 55, 255, 272, 274; 450/94, 95, 450/109, 114, 115, 116, 117, 122, 123, 128, 450/131, 150
See application file for complete search history.

(56) References Cited

U.S. PATENT DOCUMENTS

| | | | | | |
|---|---|---|---|---|---|
| 514,576 | A * | 2/1894 | Walther et al. | 2/231 |
| 792,097 | A * | 6/1905 | White | 2/252 |
| 1,330,364 | A * | 2/1920 | Wine | 2/247 |
| 1,883,461 | A * | 10/1932 | Baccaro | 2/247 |
| 2,064,724 | A * | 12/1936 | Ber | 2/227 |
| 2,116,340 | A * | 5/1938 | Chatfield | 450/146 |
| 2,410,226 | A * | 10/1946 | Martin | 2/227 |
| 2,413,141 | A * | 12/1946 | Haggar | 2/252 |
| 2,435,377 | A * | 2/1948 | Wise | 2/403 |
| 2,599,769 | A | 6/1952 | MacRae et al. | 2/228 |
| 2,757,382 | A | 8/1956 | Geissmann | 2/247 |
| 3,166,763 | A | 1/1965 | Wells | 2/112 |
| 3,457,926 | A * | 7/1969 | Bacon et al. | 450/95 |
| 3,638,242 | A | 2/1972 | Herter | 2/237 |
| 3,763,499 | A | 10/1973 | Bartos et al. | 2/227 |
| 3,987,496 | A * | 10/1976 | Bernard | 2/220 |
| 4,069,513 | A | 1/1978 | Shiller et al. | 2/227 |
| 4,637,075 | A * | 1/1987 | Ingrisano et al. | 2/94 |
| 5,052,058 | A | 10/1991 | Mueller | 2/228 |
| 5,535,451 | A * | 7/1996 | Tassone et al. | 2/227 |
| 5,598,586 | A | 2/1997 | Munjone | 2/237 |
| 5,888,118 | A | 3/1999 | Kishi | 450/122 |
| 5,946,725 | A * | 9/1999 | Shatzkin et al. | 2/106 |
| 5,978,971 | A | 11/1999 | Wald | 2/403 |
| 6,035,448 | A | 3/2000 | Thomson | 2/227 |
| 6,041,442 | A | 3/2000 | Owen | 2/228 |
| 6,543,062 | B1 * | 4/2003 | Amsel et al. | 2/227 |

(Continued)

OTHER PUBLICATIONS

Kadolph, Sara J., Textiles, 2007, Pearson Prentice Hall, 10th Edition, p. 467.*

(Continued)

*Primary Examiner* — Khoa Huynh
*Assistant Examiner* — Brieanna Fuller
(74) *Attorney, Agent, or Firm* — Ohlandt, Greeley, Ruggiero & Perle, L.L.P.

(57) ABSTRACT

A garment including a body of fabric having a waistband and at least two seams that extend from the waistband and a support structure that is connected to the at least two seams and the waistband is provided. The support structure further includes a pocket and a tape connected to the pocket that prevents elongation of the support structure between said at least two seams during the wearable life of the body of fabric.

23 Claims, 4 Drawing Sheets

U.S. PATENT DOCUMENTS

| | | | | |
|---|---|---|---|---|
| 6,550,288 | B2 | 4/2003 | Browder, Jr. et al. | 66/177 |
| 7,341,500 | B2 | 3/2008 | Horn et al. | 450/95 |
| 7,437,774 | B2 | 10/2008 | Baron et al. | 2/69 |
| 7,533,243 | B2 | 5/2009 | Takayama et al. | 712/24 |
| 2005/0198724 | A1* | 9/2005 | Steitle et al. | 2/244 |
| 2007/0136930 | A1* | 6/2007 | Dipietro | 2/227 |
| 2008/0189834 | A1 | 8/2008 | Leung | 2/406 |
| 2009/0031470 | A1 | 2/2009 | Ishikawa et al. | 2/69 |
| 2009/0083894 | A1 | 4/2009 | Causey-Gabbe | 2/78.1 |
| 2009/0106874 | A1 | 4/2009 | Shlush | 2/78.1 |
| 2010/0192284 | A1* | 8/2010 | Simon | 2/236 |

OTHER PUBLICATIONS

Brown/Rice, Ready-To-Wear Apparel Analyis, 2001, Dave Garza, Prentice-Hall, Inc., Third Edition, p. 311.*

International Search Report dated Feb. 11, 2011 from corresponding PCT/US2010/058735.

International Preliminary Report on Patentability dated Jan. 19, 2012 from corresponding PCT/US10/58735.

* cited by examiner

GARMENT HAVING SUPPORT

BACKGROUND OF THE INVENTION

1. Field of the Invention

The disclosure relates to garments having at least one support at the front of the garment. More particularly, the present disclosure relates to garments having at least one support at the inside and front of the garment that does not shrink or stretch during wearable life of the garment to provide support and control in the abdominal region of the wearer.

2. Description of the Related Art

There currently exist numerous garments that offer various degrees of shaping and support to flatter the figure of the wearer. Often such garments have support panels that feature an elastic component that stretches over a desired body part to offer shaping or support.

Unfortunately, after repeated washing of such garments, the elastic components in the support panels fail due to exposure to detergents and heating. Alternatively, such garments fail because they no longer fit the consumer as they initially did when they were purchased. After repeated washings, the support panel stretches and never regains the initial support and shaping function that provided the garment with the flattering fit.

Accordingly, there is a need for a garment that has support structure at the front of the garment that maintains shape and neither shrinks nor stretches throughout the wearable life of the garment to which it is connected.

SUMMARY OF THE INVENTION

The present disclosure provides for a garment having a support structure on the inside of the garment. The support structure includes a non-stretch tape that prevents stretching of a pocket during wear to provide for support at the front of the garment.

The present disclosure also provides for a garment having an elastic component. The garment has a pair of support structures at the inside front of the garment to which a non-stretch cotton fabric is connected to each of a pair of pockets to form a support structure that prevents stretching in the lateral direction after repeated washings of the garment. The garment provides tension at the back of the garment to keep the support structure in a taut state over the abdomen of the wearer at the front of the garment.

The present disclosure further provides a pair of jeans having support structures that are connected to the inside of the pair of jeans at the waistband, the side seams and the closure. The support structures include a pocket and a non-stretch tape that prevents stretching of the pocket to thereby provide support in the abdominal region of the pair of jeans.

The present disclosure still further provides for a garment that has non-stretch support structures disposed on opposite sides of a closure at the front of the garment to provide support and control to the wearer during the wearable life of the garment. The non-stretch support structures include a 100% cotton twill tape that prevents any stretching of the support structures in the lateral direction across the abdomen. The garment is a pair of pants or a skirt.

The present disclosure still yet further provides for an elasticized garment, such as a legging, that has an inner two-ply support structure extending across the front portion of the garment. The two-ply support structure has a tape that extends across a pocket and prevents stretching of the pocket in the lateral direction. During wear, the elasticity of the garment pulls the two-ply structure across the abdomen of the wearer to ensure a control and support in the abdominal region of the wearer.

A garment including a body of fabric having a waistband and at least two seams that extend from the waistband and a support structure that is connected to the at least two seams and the waistband is provided. The support structure includes a pocket having a tape connected to the surface of the pocket that prevents elongation of the pocket between the at least two seams during the wearable life of the body of fabric.

A garment including a body of elasticized fabric having a waistband and at least two seams that extend from the waistband is provided. The garment includes a support structure that includes a pocket and a tape that is secured to a surface of the pocket. The support structure is secured to the at least two seams and the waistband. The body of elasticized fabric maintains the support structure in a taut configuration when the garment is worn and the tape prevents elongation of the pocket during the wearable life of the garment.

These and other benefits, features and advantages will be apparent from the following detailed description.

DETAILED DESCRIPTION OF THE DISCLOSURE

Figure 1:
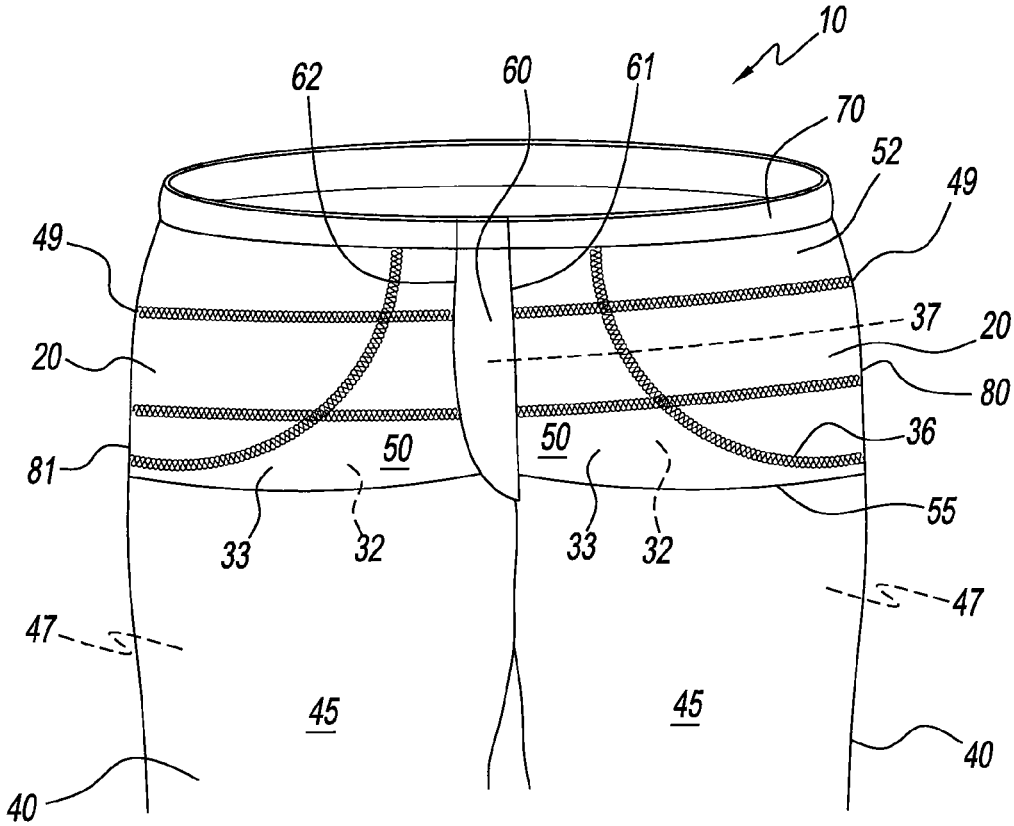
FIG. 1 illustrates a front view of an inside of a fully assembled garment having two support structures, according to a first embodiment of the present disclosures.

Referring to the drawings and in particular to FIG. 1, a fully assembled garment or body of fabric, and preferably, jeans are shown and referenced by reference numeral 10. Jeans 10, shown inside-out, include a pocket 50, according to the present invention. Pocket 50 is a two-ply component having an inner pocket material 32 and an outer pocket material 33. Pocket 50 has a rigid tape 20 connected to outer pocket material 33. Pocket 50 and tape 20 form support structure 49. Jeans 10 includes two legs 45 that each has a front panel 40 and a rear panel 47. Jeans 10 has a waistband 70, side seams 80 and 81, and a closure 60. Closure 60 has two seams 61 and 62 on either side thereof. Each leg 45 has a front panel 40 and a pocket 50; however, for purposes of simplicity a single front panel 40 and a pocket 50 will be referenced because each individual component is identical in function.

Figure 2:
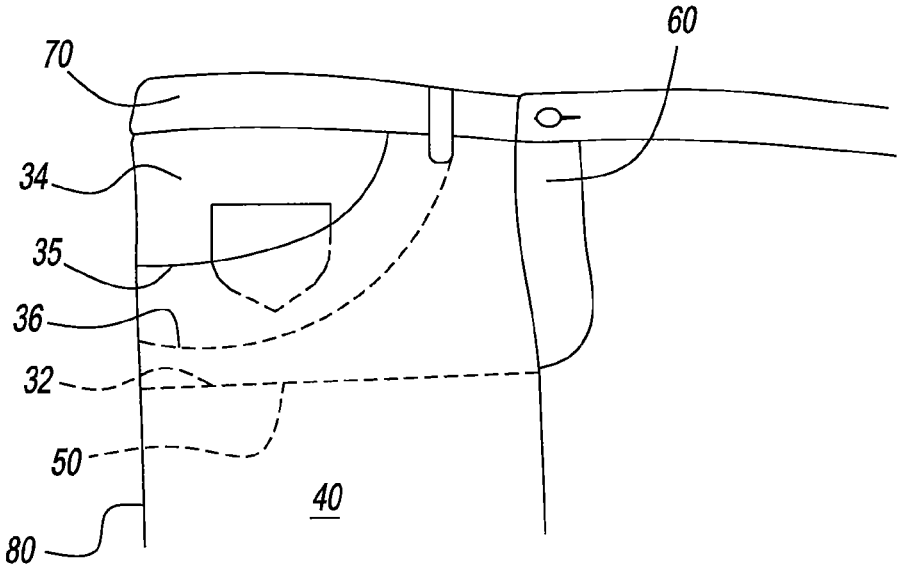
FIG. 2 illustrates a front view of the outside of the fully assembled garment of FIG. 1.

Referring also to FIG. 2, facing side of jeans 10 is shown. Pocket 50 is connected to jeans 10 and is preferably sewn to front panel 40 at side seam 80 and seam 61. Pocket 50 has a free lower edge 55 that is not connected to front panel 40.

Therefore, there exists a gap between pocket 50 and front panel 40 that is deepest proximate closure 60 and most shallow proximate side seam 80. Outer pocket material 33 is connected at three sides to side seam 80, seam 61 and waistband 70. Outer pocket material 33 is connected to visible outer pocket 34 at seam 36.

Visible outer pocket 34 and inner pocket material 32 are connected at seam 35. Inner pocket material 32 is also connected to waistband 70 and side seam 80. However, inner pocket material 32 is only connected to a portion of waistband 70 near closure 60 and a portion of side seam 80. While pocket 50 is free at edge 55, inner pocket material 32 is sewn to front panel 40 thereby restricting movement of pocket 50 away front panel 40. At free edge closer to closure 60, inner pocket material 32 is only connected to front panel 40 at waistband and seam 61.

Pocket 50 is preferably made from 100% cotton. Further, pocket 50 has a tape 20 secured to outer pocket material 33.

Tape 20 is a twill tape that is woven using a herringbone construction. A herringbone construction is a twill weave that is reversed, or broken, at regular intervals producing a zig-zag pattern. This technique produces an extremely sturdy and consistent tape that maintains the lateral integrity of tape 20. Tape 20 maintains its lateral dimension and rigidity from side seam 80 to closure 60 because of the twill weave construction. In addition to the twill weave construction of tape 20, tape 20 could also be made from other materials with similar functionality. Tape 20 is also made from 100% cotton. Alternatives to tape 20 are cotton webbing, cotton gross grain, or cotton bias tape, for example. Tape 20, due to its twill weave construction and 100% cotton composition prevent elongation of pocket 50 between seams 80 and 61 and seams 81 and 62 (on opposite leg 45) of jeans 10.

Figure 7:
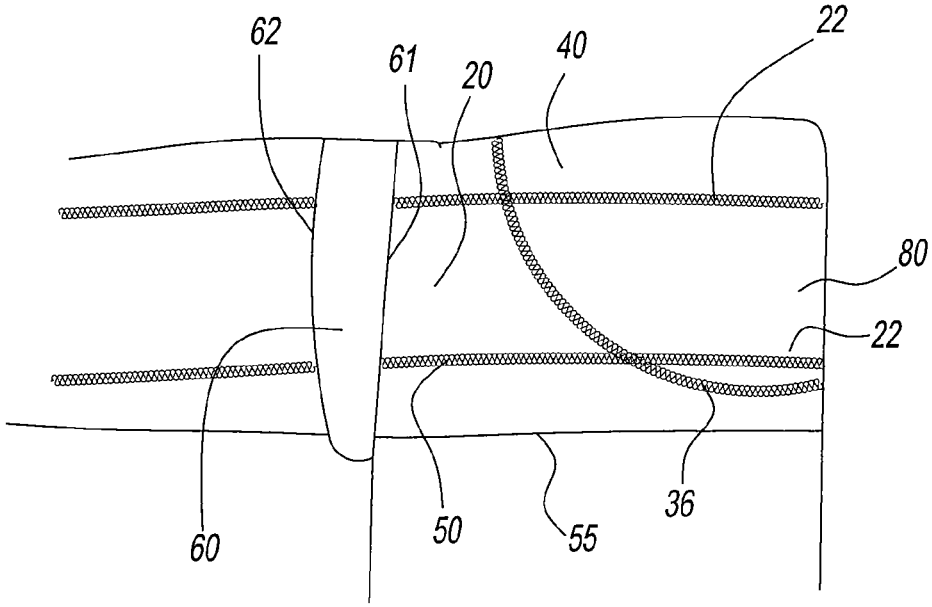
FIG. 7 illustrates a tape that covers approximately 50% of the pocket, according to the present disclosure.
Figure 8:
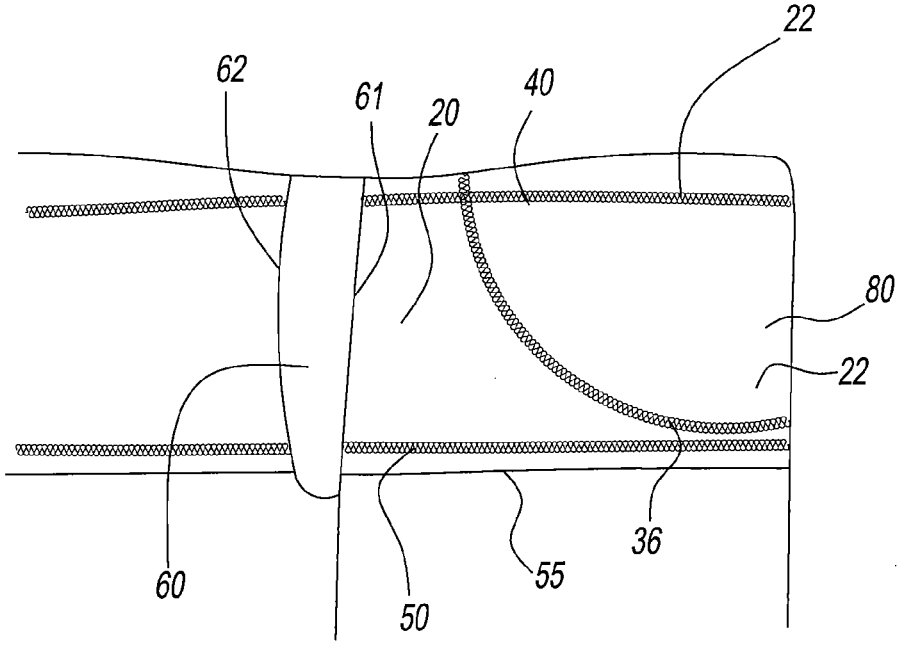
FIG. 8 illustrates a tape that covers approximately 80% of the pocket, according to the present disclosure.

Further, the width of tape 20 has a range of sizes so that it covers from approximately 50% to 80% of surface area outer support material 33 of pocket 50. By covering and being secured to a large surface area of outer support material 33, control offered by pocket 50 is greater than when tape covers a smaller surface area of pocket 50. FIG. 7 and FIG. 8 show tape 20 covering approximately 50% and 80%, respectively, of surface area of outer support material 33. Further, tape 20 is centrally located over pocket 50, and in particular, outer support material 33. Tape 20 lies over a horizontal axis that coincides with a midline 37 of outer support material 33 that extends between seams 81 and 61. By being centrally located over midline 37 of outer support material 33, tape 20 is positioned to distribute force against abdomen applied by elasticized component of jeans 10 to optimize fit.

Furthermore, pocket 50 and, in particular, outer pocket material 33, has a reinforced area 52. Reinforced area 52 is sewn to waistband 70, and side seam 80. Reinforced area 52 is also bordered by seam 36 and seam 22 of tape 20. Reinforced area 52 provides greater stiffness to pocket because it is sewn at these four locations. Reinforced area further provides an added degree of stability to pocket 50 and, in particular to outer pocket material, also because it is sewn to tape 20 at seam 22.

Jeans 10 of FIG. 1 are typically made from assembled pieces of denim fabric, such as, a sturdy cotton fabric that preferably contains an elasticized material. An elasticized material, such a Lycra®, enables pair of jeans 10 to stretch during wear and to conform to the figure of the wearer after they have been washed. Depending upon the desired color for jeans 10, the cotton from which jeans 10 are made will shrink from 8% to 13% after they have been washed by manufacturer. The percentage that jeans shrink after the washing is within an acceptable range of a standardized size. Outer pocket material 33 and inner pocket material 32 of pocket 50 and tape 20 do not contain elasticized material.

When pair of jeans 10 of FIG. 1 are washed by manufacturer, they shrink by approximately 8% to 13%, pocket 50 shrinks by approximately 4%-5% and tape 20 shrinks by approximately 4% to 5%. After, repeated washings by wearer, pocket 50, namely outer pocket material 33 and inner pocket material 32 and tape 20 remain stable and will neither stretch or shrink after wear or washings. In contrast, cotton denim from which jeans 10 are made will temporarily shrink by approximately 2% to 3% after washings by wearer, but will quickly regain the original size when purchased when donned due to the presence of elasticized material. Thus, throughout the wearable life of the jeans 10, taut support is maintained across front panels 40 of jeans 10 in location of pockets 50. The elastic component of jeans 10 provides tension at rear panels 47 that will ensure that pockets 50 will remain taut at front panels 40. The taut support 50 provide support to abdomen of wearer at front of jeans 10.

In garments, and in particular pants and skirts, that have front pockets, the pockets are not typically secured to the garment at the side seam, the closure and the waistband. Pockets of such garments are only secured at the side seam and the waistband and are not secured to the closure. In jeans 10, pockets 50 are secured to three locations, namely to waistband 70, side seam 80 and closure seam 61. Further, the inherently stable material of tape 20 that is secured to pocket 50 fixes the length of pocket 50 in the lateral dimension. When wearer dons jeans 10, the stretch caused by the elasticity at back of jeans 10 due to elasticity ensures that pockets 50 remain taut across abdomen of wearer for a supportive and flattering fit.

Figure 3:
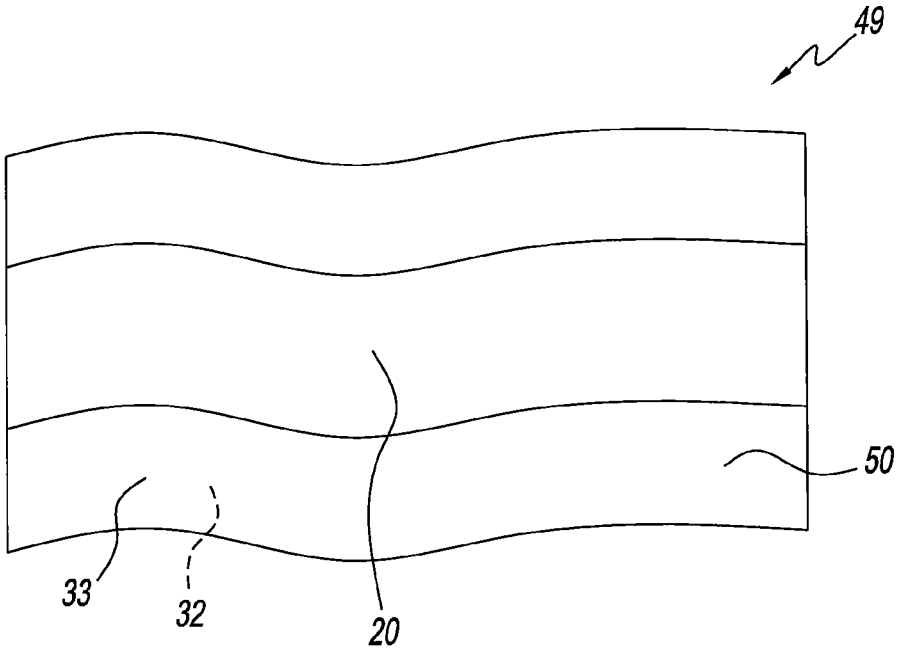
FIG. 3 illustrates a close-up view of a support or support structure, of FIG. 1 connected to a front panel of the garment.
Figure 4:
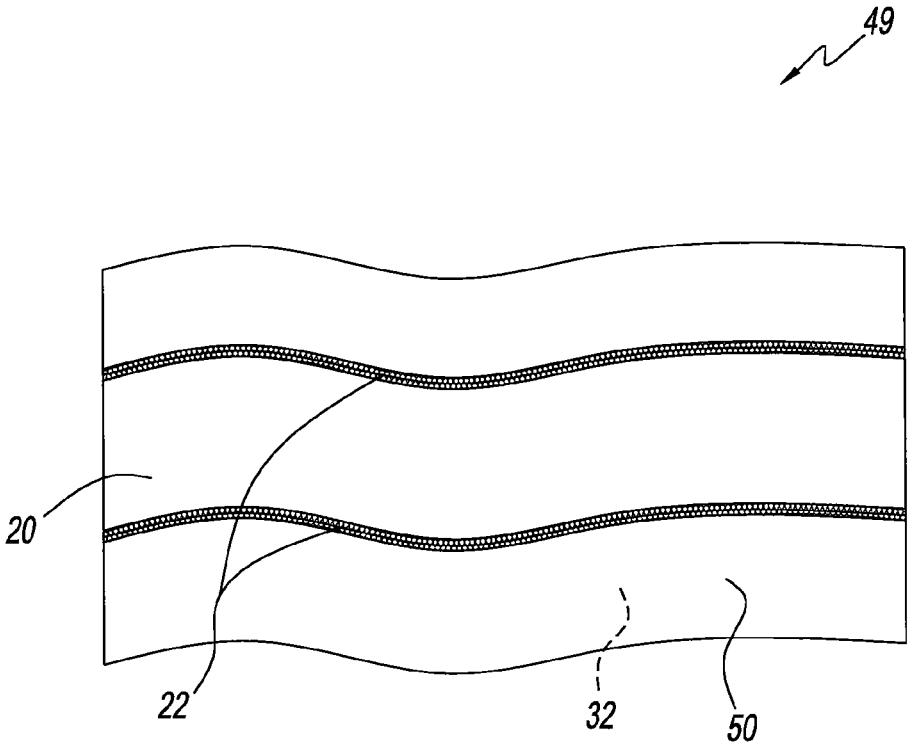
FIG. 4 illustrates the support structure of FIG. 1, showing the detail of the tape, according the first embodiment of the present disclosure.
Figure 5:
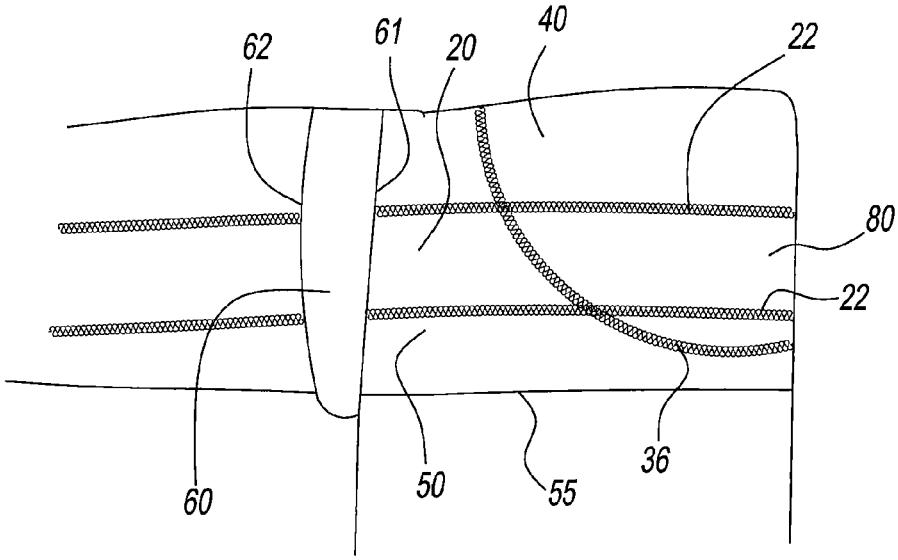
FIG. 5 illustrates the support pocket of FIG. 1, in an unassembled configuration, in which components of the support structure are not connected.

Referring to FIGS. 3 through 5, the assembly of support structures 49 is shown. Garment 10 of FIGS. 1 and 2 would have two support structures 49. In FIG. 3, tape 20 is placed on top of outer pocket material 33. In FIG. 4, tape 20 is sewn to outer pocket material 33. Tape 20 is sewn to outer pocket material 33 by two rows of cover stitch 22. Cover stitch 22 further enhances the rigidity of pocket 50 by fixing the inherently stable tape 20 to outer pocket material 33 of support pocket 50. Support structure 49, pocket 50 with tape 20, is sewn to side seam 80, seam 61 and connection near waistband 70.

Figure 6:
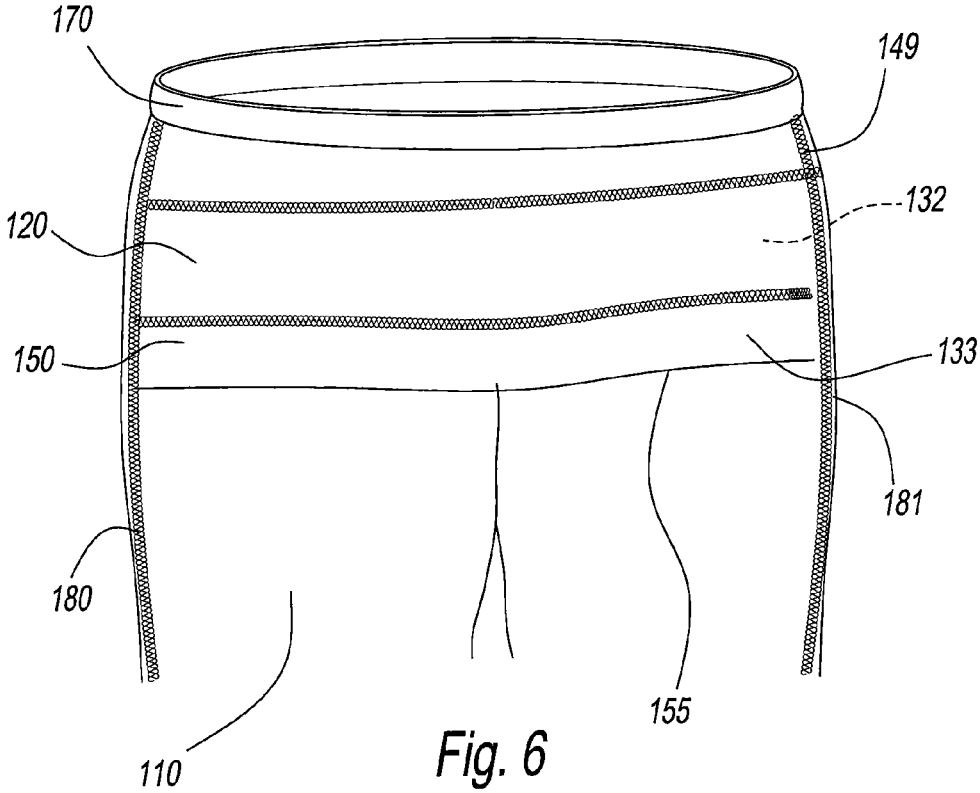
FIG. 6 illustrates a legging garment having a support structure located at the front of the garment, according to a second embodiment of the present disclosure.

Referring to FIG. 6, a second embodiment of the support structure according to the present invention is shown and is referenced by reference numeral 149. Support structure 149 includes a pocket 150 and a tape 120. Pocket 150 is connected to a garment 110, such as a pair of leggings, for example, that does not have a front closure. Pocket 150 is connected to side seams 180 and 181 and waistband 170. Pocket 150 is not connected to garment 110 at a lower free edge 155. There exists a gap between lower free edge and front of garment 110.

Pocket 150, similar to the first embodiment, is a two-ply component. Pocket 150 has an outer pocket material 133 and an inner pocket material 132. A tape 120 is connected to outer pocket material 133. Outer pocket material 133 and inner pocket material 132 are made from 100-% cotton. Tape 120 is a twill weave of 100% cotton having the identical construction as the tape 20 of the embodiment of FIGS. 1 through 5. Alternatives to tape 120 are cotton webbing, cotton gross grain, or cotton bias tape, for example. Alternatives to tape 20 may also include synthetic materials. Tape 120 prevents elongation of pocket 150 between seams side seams 180 and 181 of garment 110.

The inherent rigidity and stability of tape 120 prevents any stretching of pocket 150. The elasticity of legging 110 pulls pocket 150 across abdominal area of wearer to maintain a taut configuration and a supportive fit. Tape 120 of FIG. 6 covers approximately 50% of outer pocket material 133. A wider tape 120 that covers from up to approximately 80% of inner pocket material 132 may be used to provide greater support to the abdomen of the wearer for a firmer fit.

While the support structures of the present disclosure has been described with respect to jeans and leggings, the support structure is usable with any garment such as a skirt, leggings, shorts, dress pants, khaki pants or any garment with side seams and a waistband or side seams a central closure and a waistband.

While the present disclosure has been described with reference to particular embodiments, it should be understood that the embodiments are illustrative and that the scope of the disclosure is not limited to these embodiments. Many variations, modifications, additions and improvements to the embodiments described above are possible. It is contemplated that these variations, modifications, additions and improvements fall within the scope of the disclosure as detailed within the following claims.

We claim:

1. A garment comprising:

a body of fabric that covers at least an upper thigh area of a wearer's body; the body of fabric having a waistband and at least two seams that extend along vertical axes of the body of fabric from said waistband;

a support structure that is connected to said at least two seams and said waistband; the support structure including a pocket comprised of an inner pocket material that is away from the body of the wearer, an outer pocket material that is against the body of the wearer, and a tape that is stitched to and that covers from 50% to 80% of the outer pocket material; wherein said tape is made from 100% twill cotton and wherein said pocket does not contain elasticized material; said pocket further comprises a horizontal axis along a midline of said outer pocket material that extends between said at least two seams along a horizontal axis of the body of fabric, said midline dividing the outer pocket material into two equal sections of material, and wherein said tape being centrally disposed along the horizontal axis of said outer pocket material, said tape comprising a top portion, a bottom portion, a right side portion, and a left side portion; wherein the right side portion and the left side portion are situated along said vertical axes of the body of fabric, wherein the top portion and bottom portion extend parallel to each other between said at least two seams and are stitched to said outer pocket material so that the top portion and bottom portion are disposed parallel to said horizontal axis along said midline to prevent elongation of said pocket between said at least two seams during the wearable life of the body of fabric.

2. The garment of claim 1, wherein said pocket is made from 100% cotton.

3. The garment of claim 1, wherein said pocket is a two-ply inner pocket.

4. The garment of claim 3, wherein said body of fabric does not have a closure.

5. The garment of claim 4, wherein said body of fabric is a pair of leggings.

6. The garment of claim 1, wherein said at least two seams are two side seams that are disposed on opposite sides of said body of fabric.

7. The garment of claim 1, wherein said at least two seams are a side seam and a closure seam disposed on one side of a closure.

8. The garment of claim 7, wherein said closure is a front closure.

9. The garment of claim 8, wherein said body of fabric is a pair of jeans, a pair of dress pants, a skirt or a pair of shorts.

10. The garment of claim 8, further comprising a second side seam disposed opposite said side seam and a second closure seam disposed opposite said front closure.

11. The garment of claim 10, wherein said support structure is two support structures, wherein one of said two support structures is secured to said side seam and said closure seam and wherein a second of the two support structures is secured to said second side seam and said second closure seam.

12. The garment of claim 1, wherein said body of fabric is an elasticized body of fabric that provides tension to said support structure during wear to provide support to the abdomen of the wearer.

13. A garment comprising:

a body of elasticized fabric that covers a lower portion of a wearer's body; the body of elasticized fabric having a waistband and at least two seams that extend along vertical axes of the body of fabric from said waistband; and a support structure secured to said at least two seams and said waistband; the support structure including a pocket comprised of an inner pocket material that is away from the body of the wearer, an outer pocket material that is against the body of the wearer, and a tape that is stitched to and that covers from 50% to 80% of the outer pocket material; wherein said tape is made from 100% twill cotton and wherein said pocket does not contain elasticized material; said pocket further comprises a horizontal axis along a midline of said outer pocket material that extends between said at least two seams along a horizontal axis of the body of fabric, said midline dividing the outer pocket material into two equal sections of material, and wherein said tape being centrally disposed along the horizontal axis of said outer pocket material, said tape comprising a top portion, a bottom portion, a right side portion, and a left side portion; wherein the right side portion and the left side portion are situated along said vertical axes of the body of fabric, wherein the top portion and bottom portion extend parallel to each other between said at least two seams and are stitched to said outer pocket material so that the top portion and bottom portion are disposed parallel to said horizontal axis along said midline; and wherein said body of elasticized fabric maintains said support structure in a taut configuration when the garment is worn and said tape prevents elongation of said pocket during the wearable life of the garment.

14. The garment of claim 13, wherein said at least two seams are two side seams that are disposed on opposite sides of said body of elasticized fabric.

15. The garment of claim 13, wherein said at least two seams are side seam and a closure seam disposed on one side of a closure.

16. The garment of claim 15, wherein said closure is a front closure.

17. The garment of claim 16, further comprising a second side seam opposite said side seam and a second closure seam opposite said front closure.

18. The garment of claim 17, wherein said support structure is two support structures, wherein one of said two support structures is secured to said side seam and said closure seam and wherein a second of the two support structures is secured to said second side seam and said second closure seam.

19. The garment of claim 13, wherein said pocket is a two-ply inner pocket.

20. The garment of claim 13, wherein said pocket is made from 100% cotton that does not shrink after a first washing.

21. The garment of claim 13, wherein said tape does not shrink after a first washing.

22. The garment of claim 13, wherein said body of fabric does not have a closure.

23. The garment of claim 22, wherein said body of fabric is a pair of leggings.

* * * * *